US007441376B2

(12) United States Patent
Ishimaru et al.

(10) Patent No.: US 7,441,376 B2
(45) Date of Patent: Oct. 28, 2008

(54) BASE ISOLATION DEVICE FOR STRUCTURE

(75) Inventors: Shinji Ishimaru, Soka (JP); Hidenori Ishigaki, Yokohama (JP); Ippei Hata, Tokyo (JP)

(73) Assignee: Nihon University, School Juridical Person, Tokyo (JP)

( * ) Notice: Subject to any disclaimer, the term of this patent is extended or adjusted under 35 U.S.C. 154(b) by 722 days.

(21) Appl. No.: 10/500,169

(22) PCT Filed: Dec. 26, 2002

(86) PCT No.: PCT/JP02/13630

§ 371 (c)(1),
(2), (4) Date: Jun. 23, 2004

(87) PCT Pub. No.: WO03/056105

PCT Pub. Date: Jul. 10, 2003

(65) Prior Publication Data

US 2005/0138870 A1 Jun. 30, 2005

(30) Foreign Application Priority Data

Dec. 26, 2001 (JP) ..... 2001-394435

(51) Int. Cl.
*E04B 1/98* (2006.01)
*E04H 9/02* (2006.01)

(52) U.S. Cl. ..... 52/167.6; 52/1; 52/167.8; 248/636; 248/638

(58) Field of Classification Search ..... 52/167.1, 52/167.3, 167.6, 167.8, 167.4, 223.13, 1; 267/141, 136; 248/636, 638
See application file for complete search history.

(56) References Cited

U.S. PATENT DOCUMENTS 4,577,826 A * 3/1986 Bergstrom et al. ..... 248/638

(Continued)

FOREIGN PATENT DOCUMENTS

JP 6174009 6/1994

(Continued)

OTHER PUBLICATIONS

International Search Report for corresponding PCT application PCT/JP02/13630, mailed Apr. 22, 2003 (1 page)(citing JP 11-229319, JP 6-174009, and JP 11-229663).

(Continued)

*Primary Examiner*—Richard E. Chilcot, Jr.
*Assistant Examiner*—Chi Q. Nguyen
(74) *Attorney, Agent, or Firm*—Nash and Titus, LLC

(57) ABSTRACT

A base isolation device for a structure capable of efficiently and effectively suppressing the vibration of a structural body in surface outside direction, wherein a tension member having on overall length longer than an interval between support points provided on the structural body at a specified interval is disposed between the support points, one end parts of first link pieces are rotatably connected midway to the tension member directly or through rigid members, one end parts of second link pieces are rotatably connected to the structural body, the other end parts of the first link pieces are rotatably connected to the other end parts of the second link pieces, and an energizing member providing a tension to the tension member by energizing the first link piece and the second link piece and a damping member operated by the rotation of the first link piece and the second link piece are installed between the structural body forming the structure and connection parts between the first link pieces and the second link pieces.

10 Claims, 15 Drawing Sheets

U.S. PATENT DOCUMENTS

| | | | | |
|---|---|---|---|---|
| 4,939,939 | A * | 7/1990 | Vemmer | 73/862.44 |
| 5,315,890 | A * | 5/1994 | Long | 74/110 |
| 5,564,537 | A * | 10/1996 | Shoureshi | 188/380 |
| 6,805,337 | B1 * | 10/2004 | Rastegar et al. | 267/136 |
| 6,966,154 | B1 * | 11/2005 | Bierwirth | 52/167.4 |
| 2007/0082794 | A1 * | 4/2007 | Sams, III | 482/92 |

FOREIGN PATENT DOCUMENTS

| | | |
|---|---|---|
| JP | 10-169244 | 6/1998 |
| JP | 27-90185 | 6/1998 |
| JP | 10-220526 | 8/1998 |
| JP | 29-88882 | 8/1998 |
| JP | 11-229663 | 8/1999 |
| JP | 11229319 | 8/1999 |

OTHER PUBLICATIONS

International Preliminary Examination Report for corresponding PCT application PCT/JP02/13630, mailed Mar. 16, 2004 (6 pages)(citing JP27-90185, JP 11-229663, JP 10-169244, and JP 29-88882).

* cited by examiner

BASE ISOLATION DEVICE FOR STRUCTURE

This application is a national filing pursuant to 35 U.S.C Section 371 based on PCT/JP02/13630, filed Dec. 26, 2002.

BACKGROUND OF THE INVENTION

1. Field of the Invention

This invention relates to a base isolation device for a structure, and more particularly to a base isolation device for a structure that is applied to a structure having structural members such as slabs in elevated freeways, elevated railway tracks, or bridge constructions, and suppresses vibration in the out-of-plane direction of the structural members.

Moreover, the invention can also be applied to a base isolation device that suppresses vibration in the out-of-plane direction of structural members of an inclined roof, or structural-support members of a vertically placed glass curtain wall.

2. Description of the Related Art

In recent years, various measures have been employed for suppressing damage such as collapse or failure of structures comprising structural elements such as the slabs in elevated freeways, elevated railway tracks, or bridge constructions due to vertical vibration of the structural members that occurs during traffic vibration or an earthquake, and one of the measures that has been proposed is the base isolation device shown in FIG. 5.

The base isolation device that is indicated by reference number 1 in this FIG. 5, is applied to a floor slab 3 that is arranged horizontally as a structural member that is supported by a plurality of bridge supports 2, for example, and underneath the floor slab 3, in about the center between the bridge supports 2, an elastic member 4 comprising a spring or the like, and a damping member 5 comprising an oil damper or the like are suspended such that they are parallel with each other, and a weight member 6 is attached to the bottom section of the elastic member 4 and damping member 5.

In this prior base isolation device 1 constructed in this way, when vibration in the out-of-plane direction (in the vertical direction in the example shown in the FIG. 5) occurs in the floor slab 3, the vertical vibration of the floor slab 3 is suppressed by damping the relative motion between the floor slab 3 and the weight member 6 by the elastic member 4 and damping member 5.

In this kind of prior art, there still remain the following problems that must be improved.

In other words, in the prior art described above, in order to efficiently suppress the vertical vibration in the floor slab 3, it is necessary to properly set the elastic coefficient of the elastic member 4 and the damping coefficient of the damping member 5 in accordance to the characteristic natural frequency of the floor slab 3, however, in order to do this, there is a problem in that the range capable of obtaining an effective base isolation function is narrow, and the setting of which is difficult.

Moreover, the weight member 6 is more effective the heavier it is, however, in an actual structure, it was difficult to attach a weight that was 10% the weight of the entire structure.

Furthermore, since the weight member 6 acts only in the direction of gravitational acceleration, installing this prior base isolation device in the structural members of an inclined roof, or the structural-support members of a vertically placed glass curtain wall was impossible.

SUMMARY OF THE INVENTION

Taking these prior problems into consideration, the object of this invention is to provide a base isolation device for a structure that is capable of effectively suppressing vibration in the out-of-plane direction of the structural members of a structure.

In order to accomplish the object described above, the base isolation device for a structure according to the first embodiment of the invention is a base isolation device for a structure that suppresses vibration in the out-of-plane direction of a structural member of the structure and comprises: In the base isolation device for a structure according to the seventh embodiment of the invention, the damping member of any one of the described embodiments is an active damper, and together with locating a sensor for detecting shaking on said structural member, a controller is installed that adjusts the operation of said active damper based on the detection signal from the sensor.

In the base isolation device for a structure according to the eighth embodiment of the invention, the sensor of the seventh embodiment is an acceleration sensor.

In the base isolation device for a structure according to the ninth embodiment of the invention, the sensor of the seventh embodiment is a displacement sensor.

In the base isolation device for a structure according to the tenth embodiment of the invention, the sensor of the seventh embodiment is a velocity sensor.

In the base isolation device for a structure according to the eleventh embodiment of the invention, the damping member of any one of the described embodiments is a viscoelastic member or elasto-plastic member.

DESCRIPTION OF THE PREFERRED EMBODIMENTS

Figure 1:
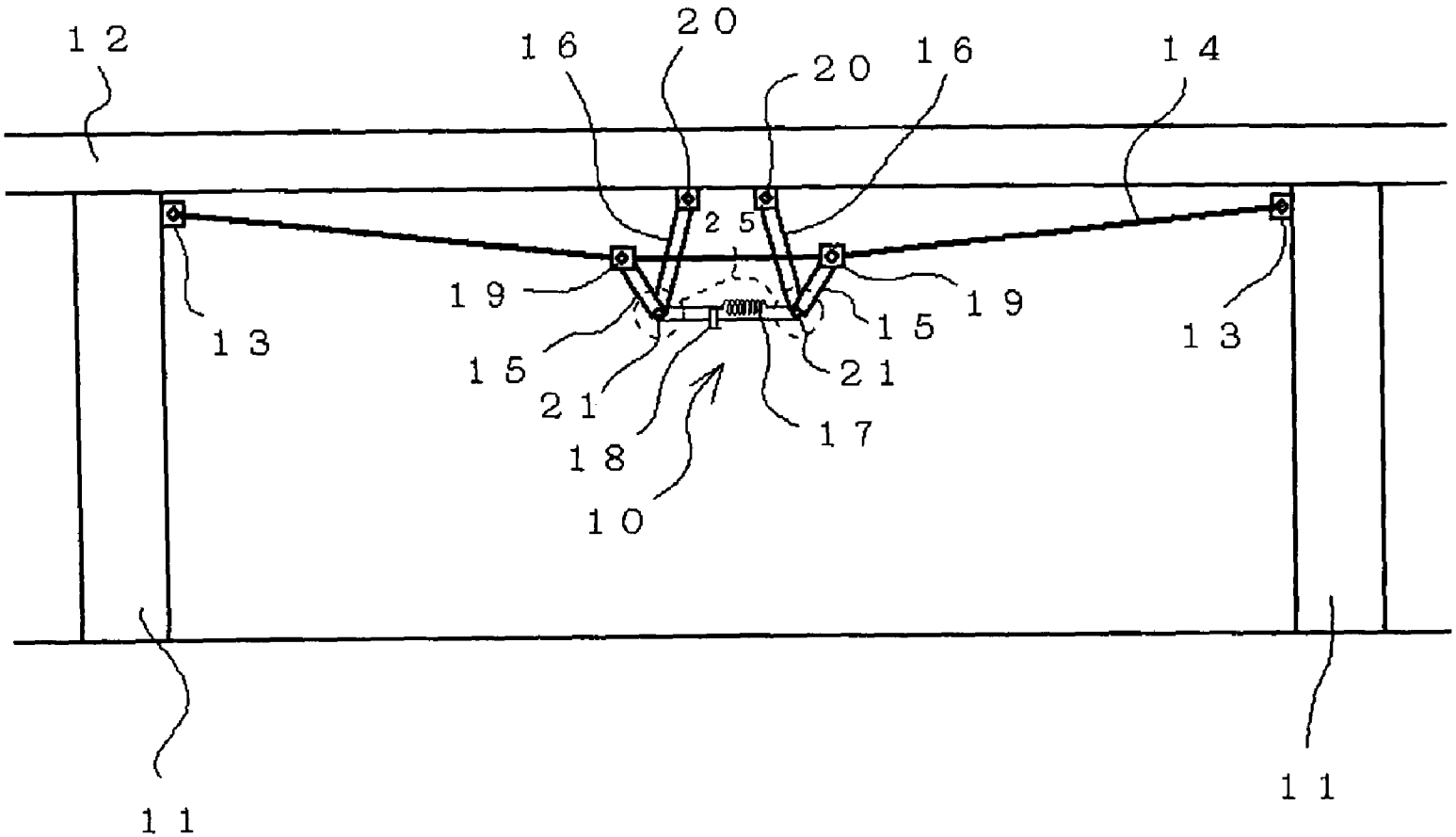
FIG. 1 is a front view showing the main parts of a first embodiment of the present invention.

A first embodiment of the present invention will be explained below with reference to FIG. 1 to FIG. 3.

The base isolation device 10 for a structure of this embodiment, which is indicated by the reference number 10 in FIG.

1, is applied to a floor slab 12, which is a structural member that is supported by a plurality of bridge supports 11, and is basically constructed by comprising: support points 13 that are located underneath the floor slab 12 and separated by a specified space (in this embodiment, they are located on adjacent bridge supports 11), and where a tension member 14 is placed in between these support points 13 having an overall length that is longer than the space, and where first link pieces 15 are connected to points along the tension member 14 such that they can rotate freely, and second link pieces 16 that are connected between the first link pieces 15 and the floor slab 12 such that they can rotate freely; an energizing member 17 that applies tension to the tension member 14 by energizing the first link pieces 15 and second link pieces 16 between the connections of the first link pieces 15 and second link pieces 16 and the structural member of the structure (floor slab 12 in this embodiment); and a damping member 18 that is operated by the rotation of the first link pieces 15 and second link pieces 16.

Also, there is an added mass 25 located in the connections 21 between the first link pieces 15 and second link pieces 16.

To explain these in more detail, in this embodiment, rope is used as the tension member 14 and both ends are fastened to the support points 13 that are located on the bridge supports 11.

In this embodiment, the first link pieces 15 and second link pieces 16 are located underneath the floor slab 12, and are located at two places separated by a space midway in the space between adjacent bridge supports 11 in the length direction of the tension member 14, and one end of each of the first link pieces 15 is connected to the tension member 14 by way of a pin 19 such that it can rotate freely, and one end of each of the second link pieces 16 is connected to the bottom of the floor slab 12 by way of a pin 20 such that it can rotate freely.

Moreover, the other end of each of the first link pieces 15 and second link pieces 16 are connected together by way of a pin 21 such that they can rotate freely, as well as an added mass 25 is added, and furthermore, the first link pieces 15 are formed such that they are shorter than the second link pieces 16, and the pins 21 of the connections between the first link pieces 15 and second link pieces 16 are located on the inside between both pins 19 of the connections between the first link pieces 15 and the tension members 14.

Figure 2:
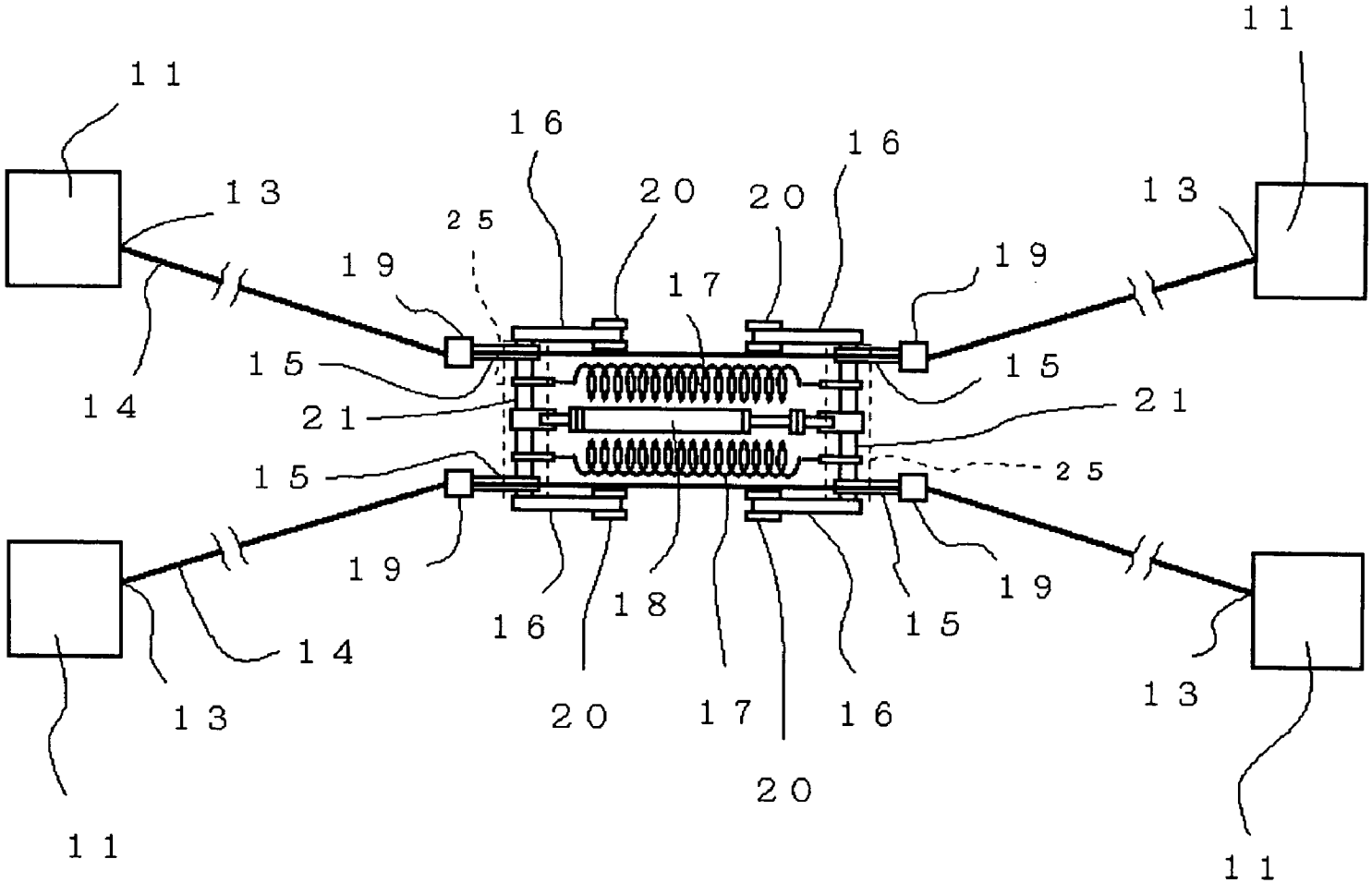
FIG. 2 is a plane view showing the main parts of a first embodiment of the present invention.

Furthermore, in this embodiment, as shown in FIG. 2, base isolation devices 10 are mounted between a pair of bridge supports 11 that are located such that they are parallel in the plane direction of the floor slab 12, and the two pins 21 that connect the first link pieces 15 and second link pieces 16 of each base isolation device 10 are shared, and they (pins 21) are made sufficiently heavy in order that they can take on the role of the added mass 25, and a pair of energizing members 17 are located in parallel between these pins 21, and furthermore a damping member 18 is located between these energizing members 17 and is connected to both pins 21.

Also, both energizing members 17 are constructed using tension springs, and by energizing both pins 21 in a direction such that they approach each other, and by energizing the pins 19, which are the connections of each of the first link pieces 15 with the tension members 14, in a direction such that they become separated from the floor slab 12, tension is applied to the tension members 14 and keeps the tension members 14 in a state of tension.

Next, the operation of the base isolation device 10 of this embodiment constructed in this way will be explained.

When an earthquake or the like occurs, the floor slab 12 vibrates in the vertical direction, which is the out-of-plane direction of the floor slab 12, such that the bridge supports 11 are fixed ends, and the middle section bends.

Figure 3:
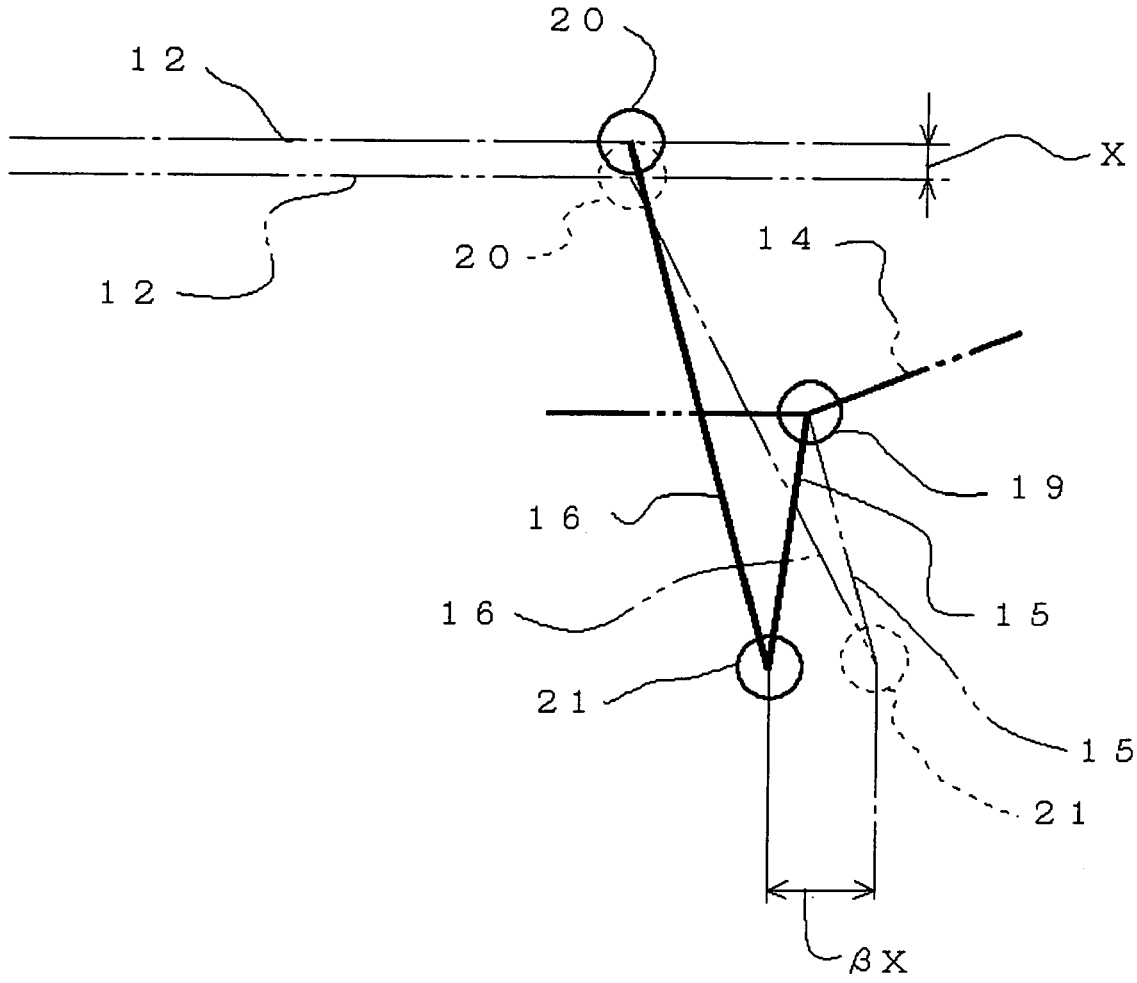
FIG. 3 is an enlarged view of the main parts for explaining the operation of a first embodiment of the present invention.

Moreover, as shown in FIG. 3, when the floor slab 12 bends downward from the normal state as shown by the single-dot dashed line to the state shown by the double-dot dashed line, for example, each of the pins 20 moves downward together with the floor slab 12, and each of the second link pieces 16 that are connected to the pins 20 receive a force that also similarly moves them downward.

However, by keeping the tension members 14 in a state of tension, the positions of the pins 19, which are one of the connections with the first link pieces 15, are restricted, so as the second link pieces 16 move downward as described above, the second link pieces 16 are rotated around the center of the pins 19.

The direction of rotation of the first link pieces 15 is in a direction such that the pins 21, which are the connections with the second link pieces 16, move away from each other, and inertial force acts together with the gravitational force on the added mass 25 connected directly to the pins 21.

As a result, both of the energizing members 17 located between both pins 21 expand and together with keeping the tension members 14 in a state of tension, the damping member 18 is expanded, and the damping function occurs.

From this, the vertical vibration of the floor slab 12 described above, is converted to motion of the added mass 25, and due to the occurrence of the damping function, the vertical vibration of the floor slab 12 is suppressed.

On the other hand, as shown in FIG. 3, when the amount of bending of the floor slab 12 is taken to be X, and the amount of displacement in the horizontal direction of the pin 21 is taken to be $\beta X$, by constructing an amplification mechanism with the first link pieces 15 and second link pieces 16, '$\beta >> 1$', and as a result, the amount of operation of the damping member 18 increases, and by taking the mass of the added mass 25 to be m', then that movement is $\beta m' \cdot X$, from lever theory, the inertial force acting on the floor slab 12 is $\beta 2m' \cdot X$, and the added mass 25 has actual motion $m'\beta 2$, so the mass effect increases.

Also, when the floor slab 12 vibrates upward, movement is in the direction that will do away with the state of tension of the tension members 14, however, by always having both pins 21 be energized by the energizing members 17 in the direction toward each other, the state of tension in the tension members 14 described above is maintained.

Therefore, the movement of the first link pieces 15 or the damping member 18 is in the opposite direction from the direction described above, and by the same amplification mechanism, the damping effect is increased.

As a result, an effective damping function for vertical vibration, which is the out-of-plane direction of the floor slab 12, is obtained, and thus it is possible to obtain an elevated isolation function.

The shape and dimensions of the components shown for the embodiment described above are examples, and various modifications are possible based on the design requirements.

Figure 4:
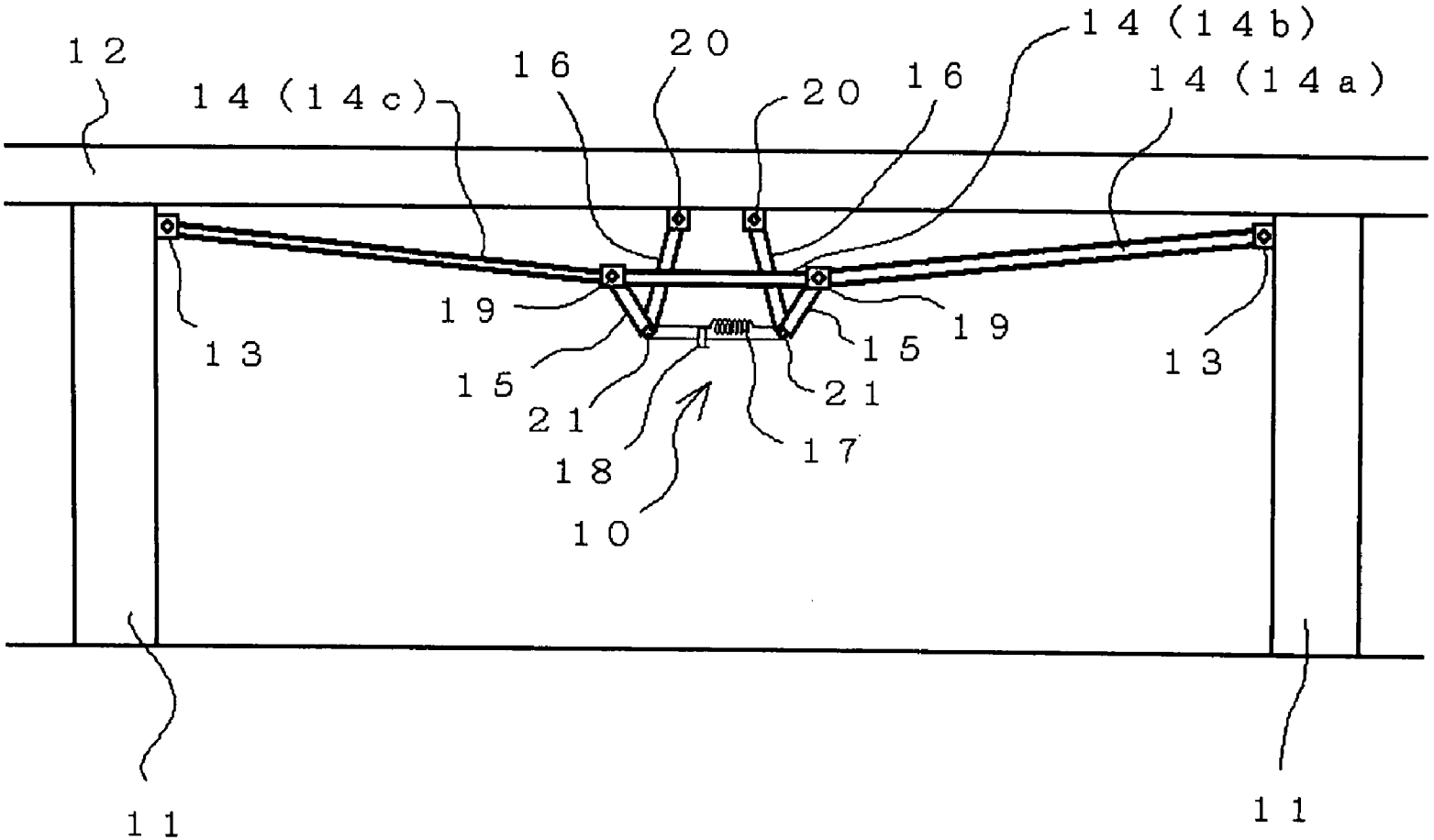
FIG. 4 is a front view showing another embodiment of the present invention.
Figure 5:
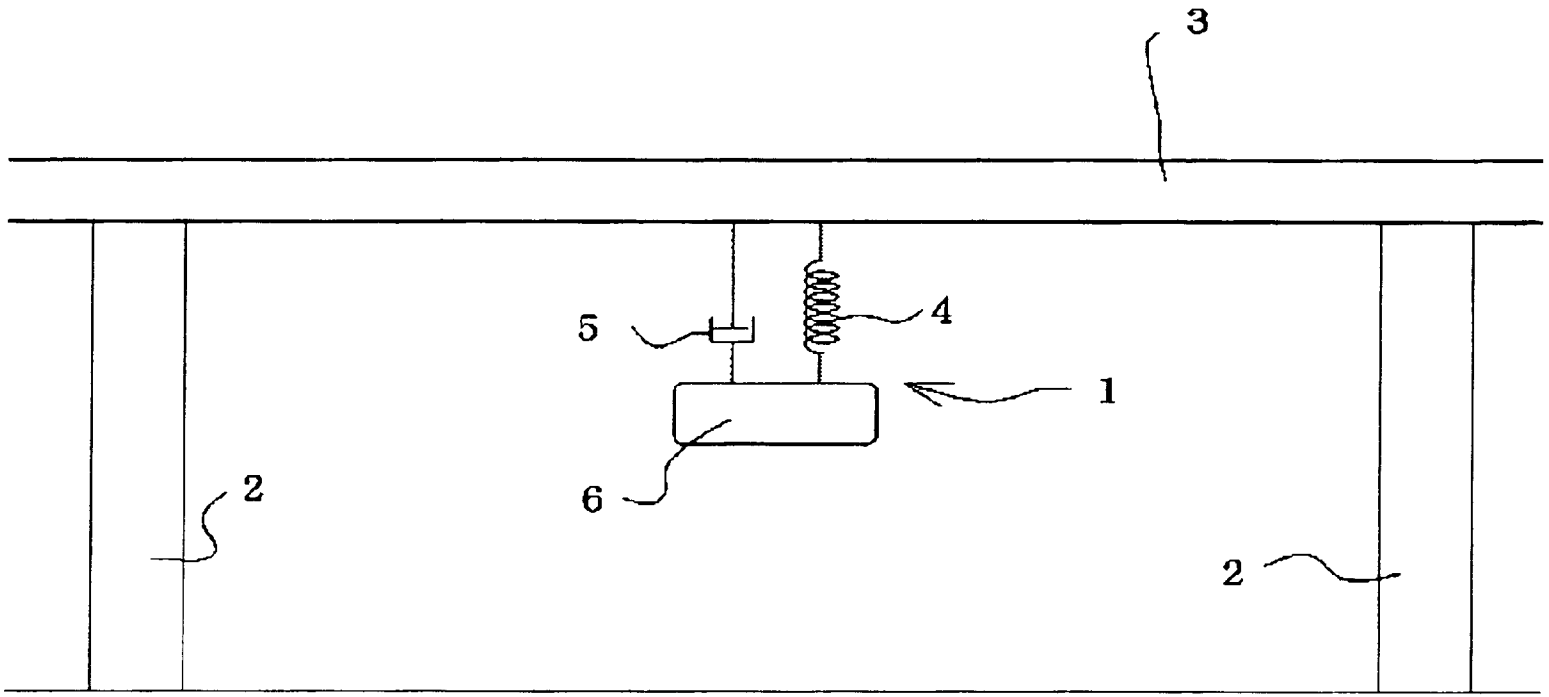
PRIOR ART Fig.5
FIG. 5 is a front view of the main parts of a prior example.

For example, in the embodiment described above, an example was given of constructing the tension member 14 with rope, however, instead of this, it is also possible to construct it using a plurality of steel rods 14*a*, 14*b*, 14*c* as shown in FIG. 4.

Also, an oil damper was shown as an example of the damping member 18, however, instead of this, it is also possible to use a viscoelastic member or elasto-plastic member.

Figure 6:
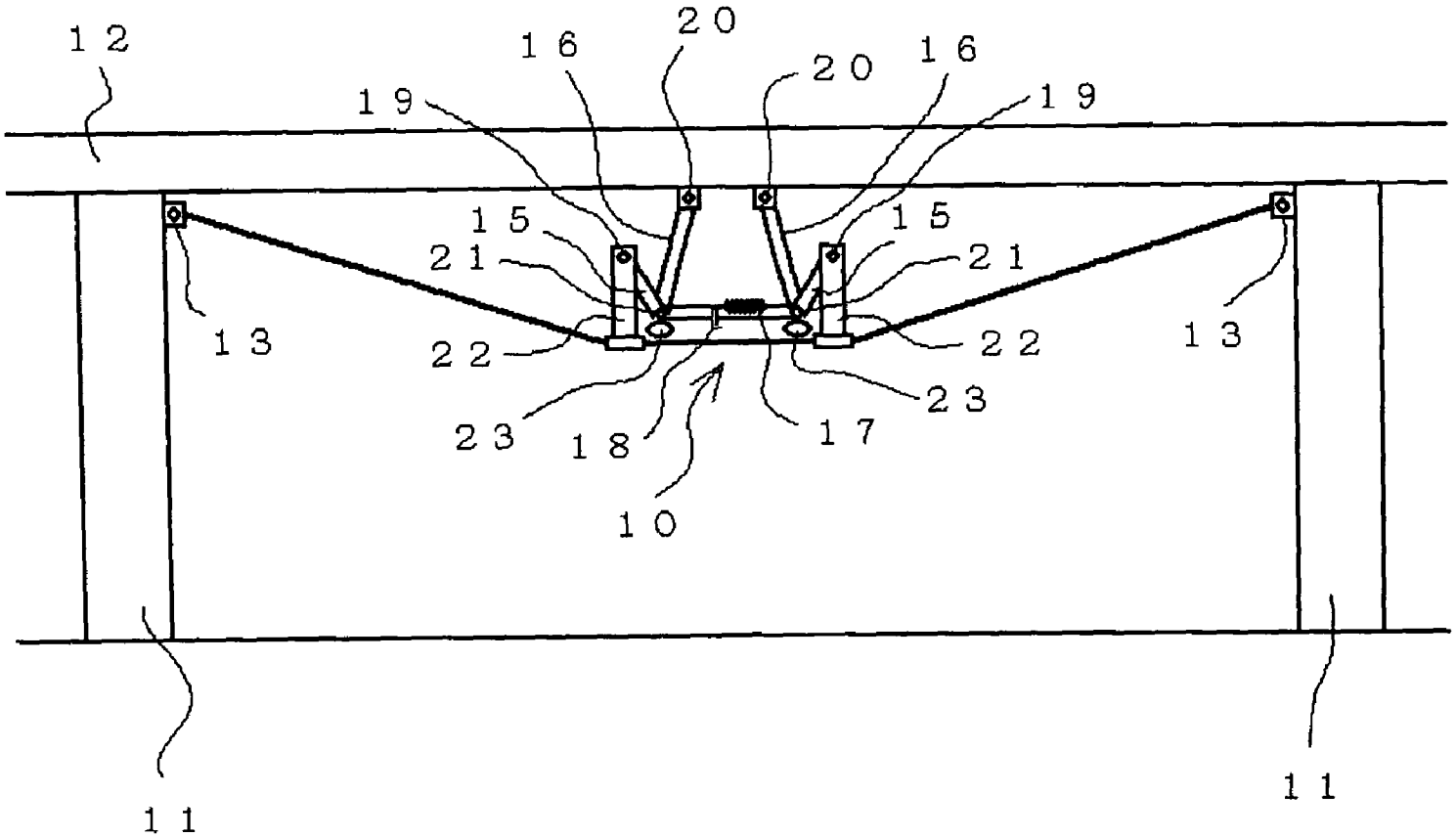
FIG. 6 is a front view showing another embodiment of the present invention.

Also, as shown in FIG. 6, it is also possible to install connection legs 22 to the tension member 14, and to connect the ends of the first link pieces 15 to these connection legs 22 by way of pins 19 such that they can rotate freely, and it is also possible to install, for example, weights 23 to the pins 21 to increase the inertial mass of the moving parts of the base isolation device 10.

Figure 7:
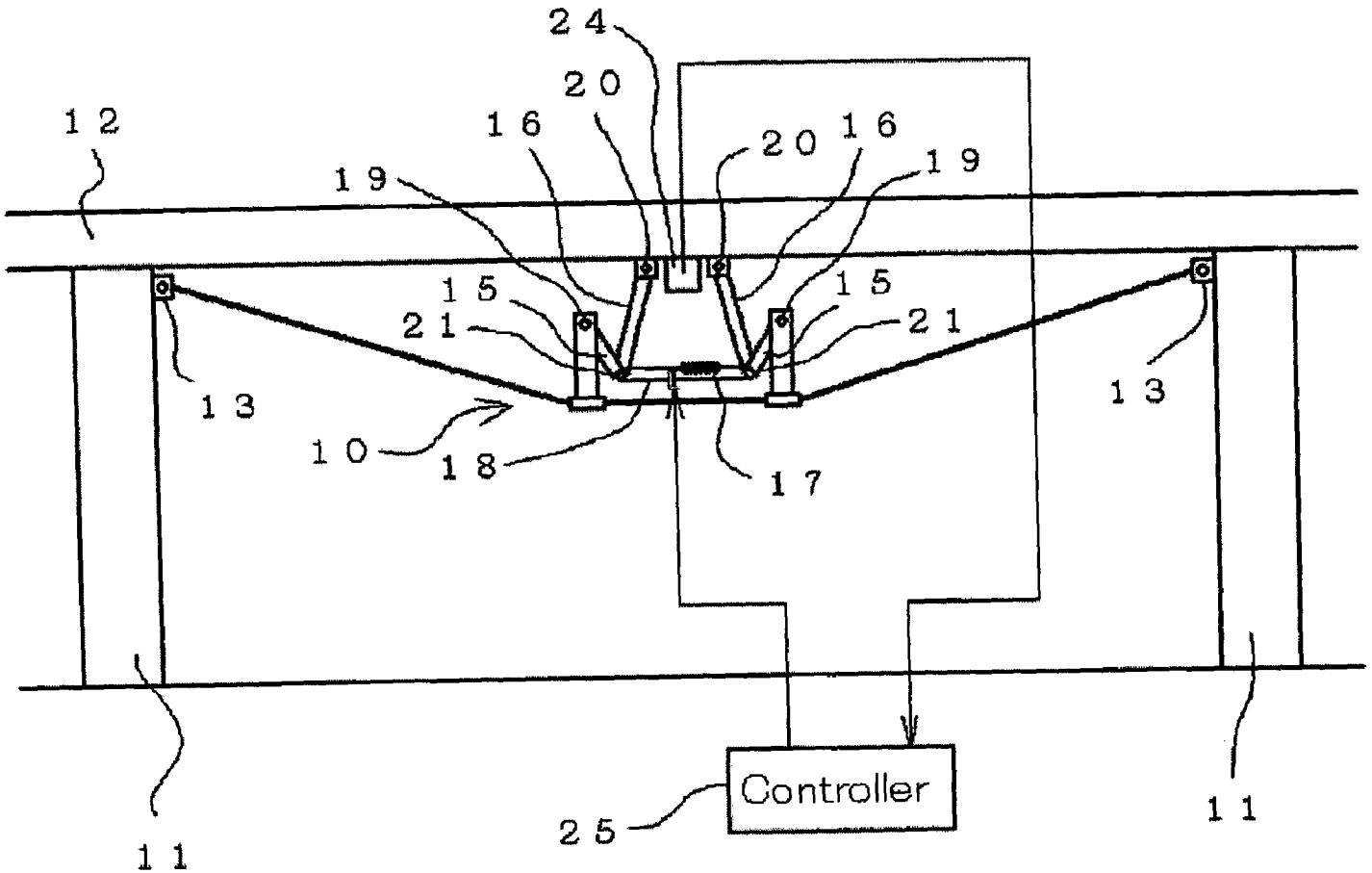
FIG. 7 is a front view showing another embodiment of the present invention.

Moreover, it is possible to used an active damper for the damping element 18, and as shown in FIG. 7, to install a sensor 24 to the floor slab 12 that detects shaking of the floor slab 12, and further, it is possible to install a controller 25 that adjusts the opening of a variable orifice based on a detection signal from the sensor 24, and adjust the damping force of the damping member 18 to a proper value by adjusting the opening of the variable orifice with this controller 25 according to the amount of shaking detected by the sensor 24.

Also, a displacement sensor that detects the amplitude of vibration of the floor slab 12 during vibration, or an acceleration sensor that detects the acceleration of shaking of the floor slab 12 can be used as the sensor 24.

Besides the example of structural members described above, man-made ground such as that of a footbridge, bridge over railway tracks, multi-level parking structure, or elevated walkway is also feasible.

An example was given in which support points 13 were located on the bridge supports 11, however, they could also be located on the floor slab 12, which is the structural member.

This embodiment could also be used as a base isolation device that suppresses the vibration in the out-of-plane direction of the structural members of an inclined roof, or the structural-support members of a vertically standing glass curtain wall.

On the other hand, the connected state of the first link pieces 15 and second link pieces 16, and tension member 14, as well as the position of the energizing member 17 and damping member 18 can be changed as appropriate.

Figure 8A:
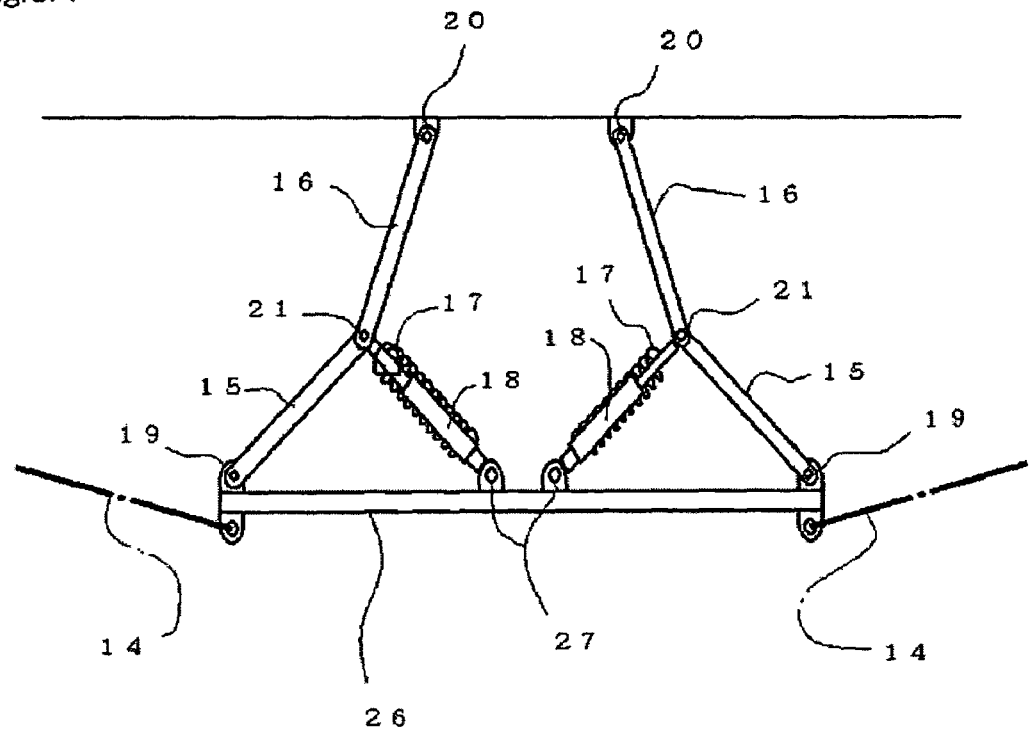
FIG. 8A and FIG. 8B are front views showing examples of modifications to the present invention.
Figure 8B:
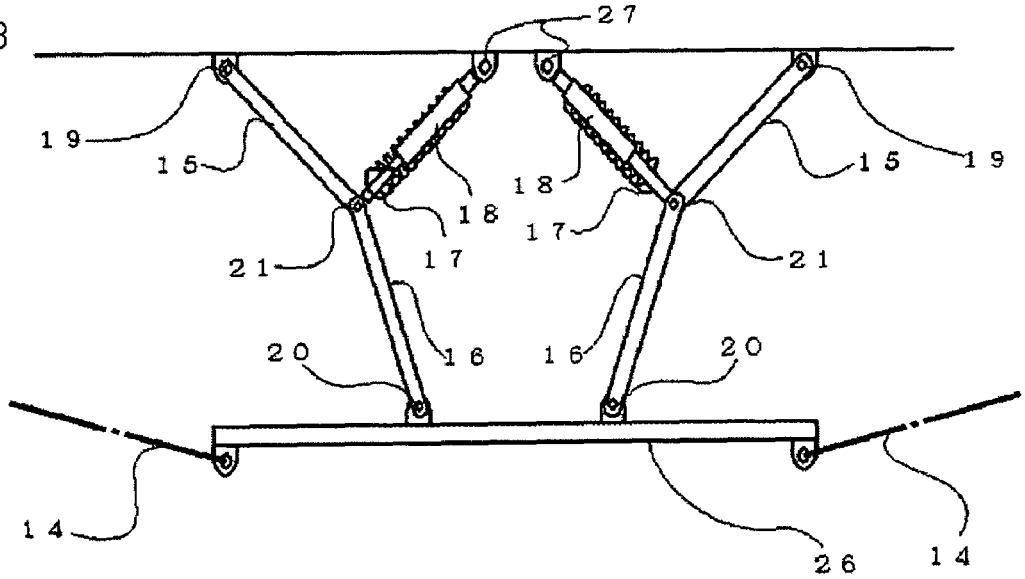
Figure 9:
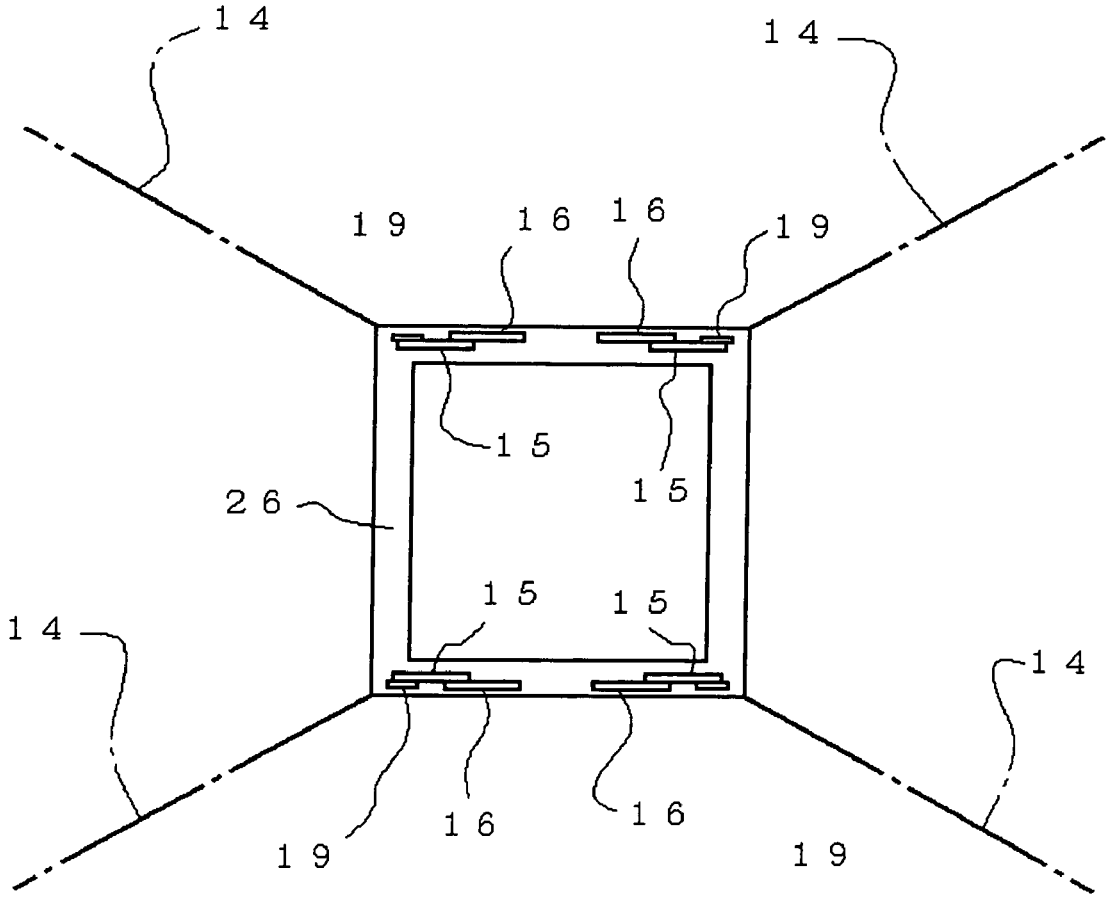
FIG. 9 is a plane view showing an example of a modification to the present invention.

For example, as shown in FIG. 8A, construction is also possible in which a rectangular-shaped frame member 26 as shown in FIG. 9, is placed underneath the floor slab 12, and this frame member 26 is supported by running tension members 14 between each corner of this frame member 26 and the bridge supports 11 or floor slab 12, and the end sections of a pair of parallel sides of this frame member 26 and the floor slab 12 are connected by the first link pieces 15 and second link pieces 16, which are connected such that they can rotate freely, and furthermore, the energizing members 17 and damping members 18 are located between the pins 21, which make up the connections between the first link pieces 15 and the second link pieces 16, and the pins 27, which are located on the parallel sides of the frame member 26 and between the pins 21. It is also possible to reverse the top and bottom as shown in FIG. 8B.

Here, the pins 21 that connect the first link pieces 15 and second link pieces 16 are located further on the inside of the frame member 26 than the straight lines that connect the pins 19 and pins 20.

Moreover, the energizing members 17 comprise compression springs, and by energizing both pins 21 with these energizing members 17 in a direction such that they move apart from each other, the frame member 26 is energized downward, and a constant tensile force acts on the tension members 14.

Figure 10:
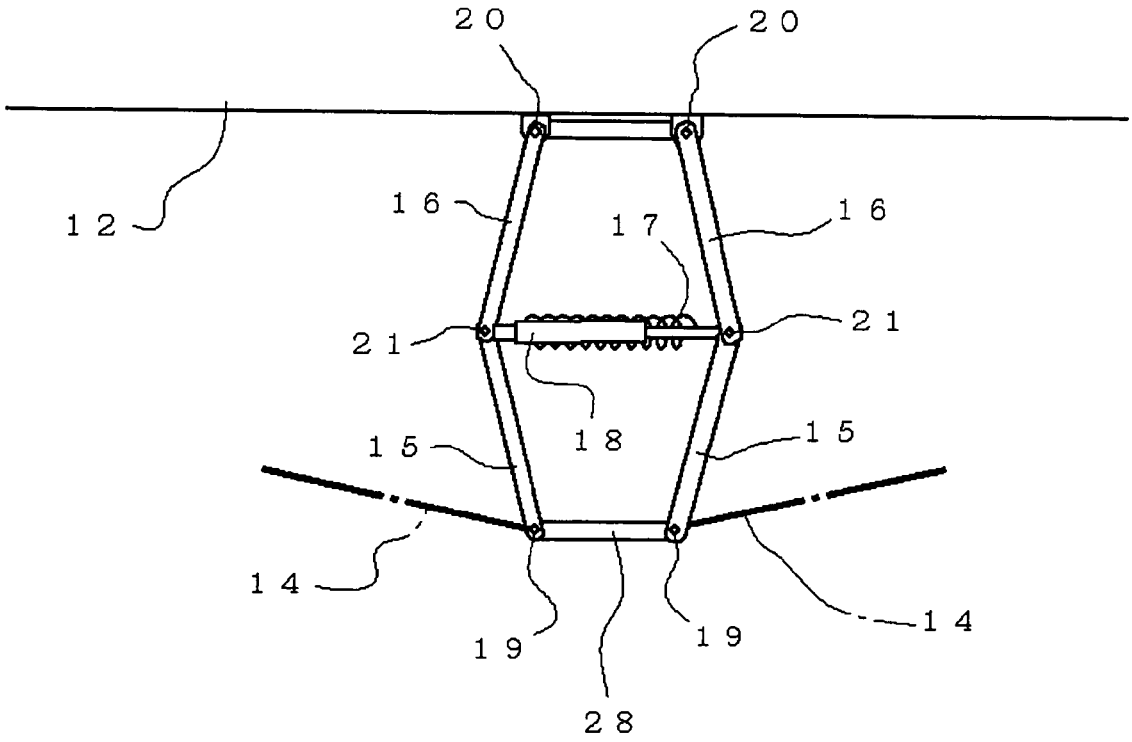
FIG. 10 is a front view showing an example of a modification to the present invention.

Furthermore, as shown in FIG. 10, construction is also possible in which pins 20 are located underneath the floor slab 12 and separated by a set space, the second link pieces 16 are connected to these pins 20 such that they can rotate freely, and the first link pieces 15 are connected to the other end of the second link pieces 16 by way of pins 21 such that they can rotate freely, and furthermore the other ends of the first link pieces 15 are connected to the ends of a connection link piece 28, which is placed such that it is parallel with the line that connects both pins 20, by way of pins 19, the energizing member 17 and damping member 18 are located between the pins 21, and the tension members 14 running between both ends of the connecting link 28 and the floor slab 12 or bridge supports 11.

Here, the pins 21 are located further on the outside than the lines that connect the pins 19 and pins 20, and the energizing member 17 comprises a tension spring, such that by having the energizing member 17 energize the pins 21 in a direction approaching each other, the connection link piece 28 is energized downward and constant tensile force is applied to the tension members 14.

Figure 11:
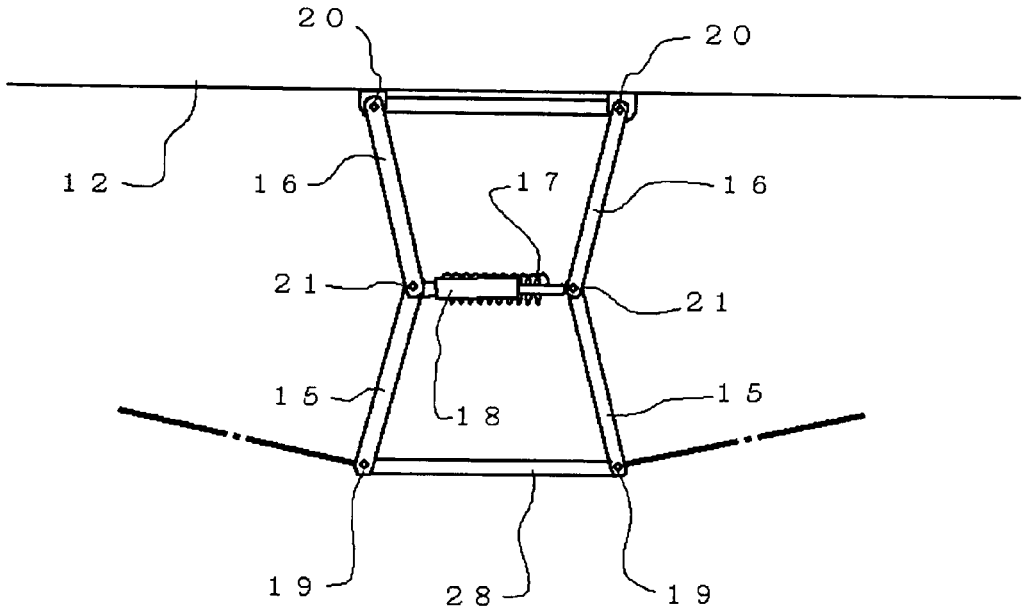
FIG. 11 is a front view showing an example of a modification to the present invention.

Also, as shown in FIG. 11, construction is also possible in which the pins 21 are located further on the inside than the lines that connect the pins 19 and pins 20, and the energizing member 17 is a compression spring that energizes both pins 21 such that they move apart from each other.

Figure 12:
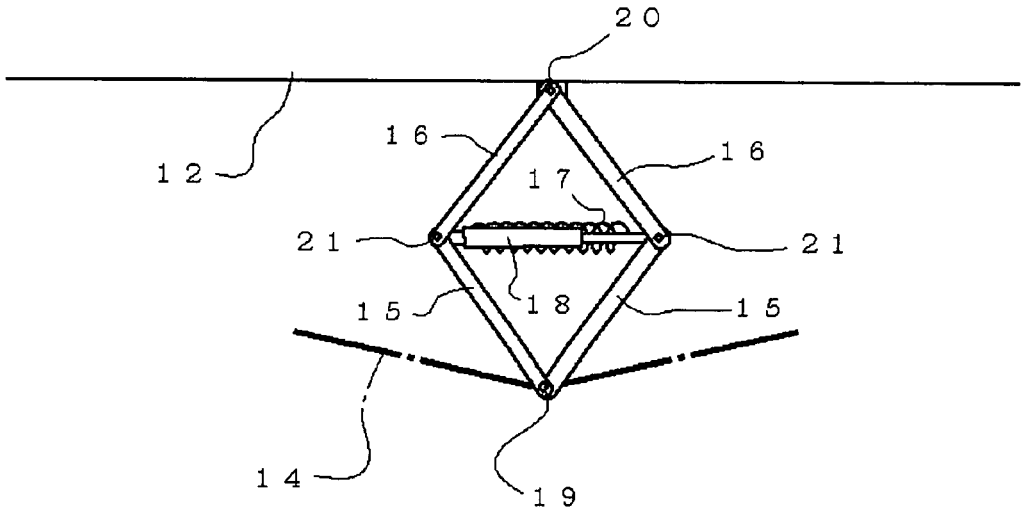
FIG. 12 is a front view showing an example of a modification to the present invention.

Also, as shown in FIG. 12, construction is also possible in which the pair of second link pieces 16 shown in the modification of FIG. 10 are connected by one pin 20, and furthermore, the other ends of the pair of first link pieces 15, which are connected to the other ends of these second link pieces 16 such that can rotate freely, are connected to the tension member 14 by way of one pin 19.

Also, a damping member 18 and energizing member 17 are placed between the pins 21 that connect the first link pieces 15 and the second link pieces 16, and in this example, this energizing member 17 is constructed using a tension spring.

Figure 13A:
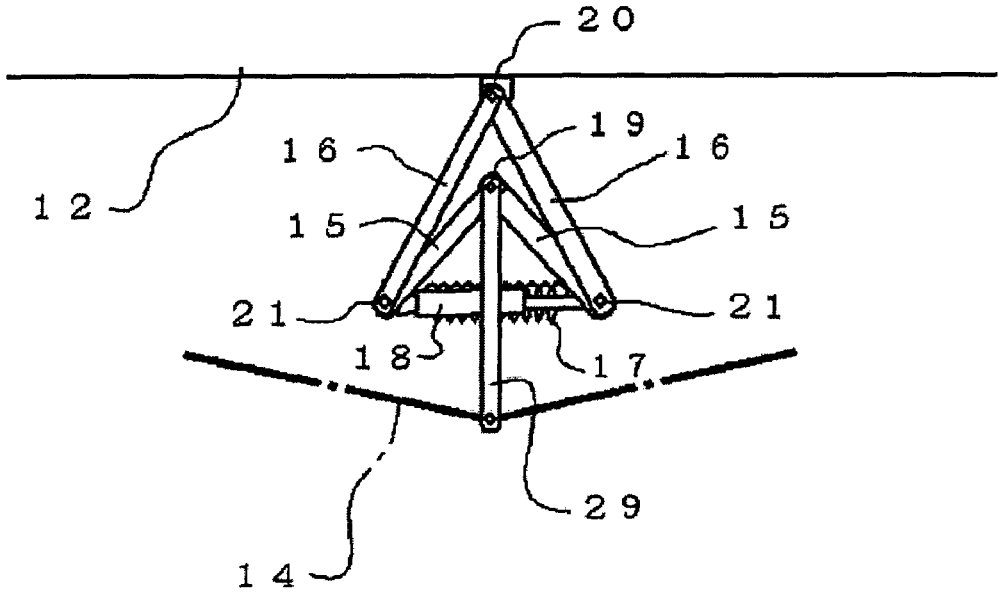
FIG. 13A, FIG. 13B and FIG. 13C are front views showing examples of modifications to the present invention.

Furthermore, as shown in FIG. 13A, construction is also possible in which the other ends of the pair of first link pieces 15 shown in FIG. 12 are connected on the inside of the pair of second link pieces 16 by pin 19, which is above both pins 21, and a downward facing connection rod 29 is connected to this pin 19, and this connecting rod 29 is connected to the tension member 14.

Figure 13B:
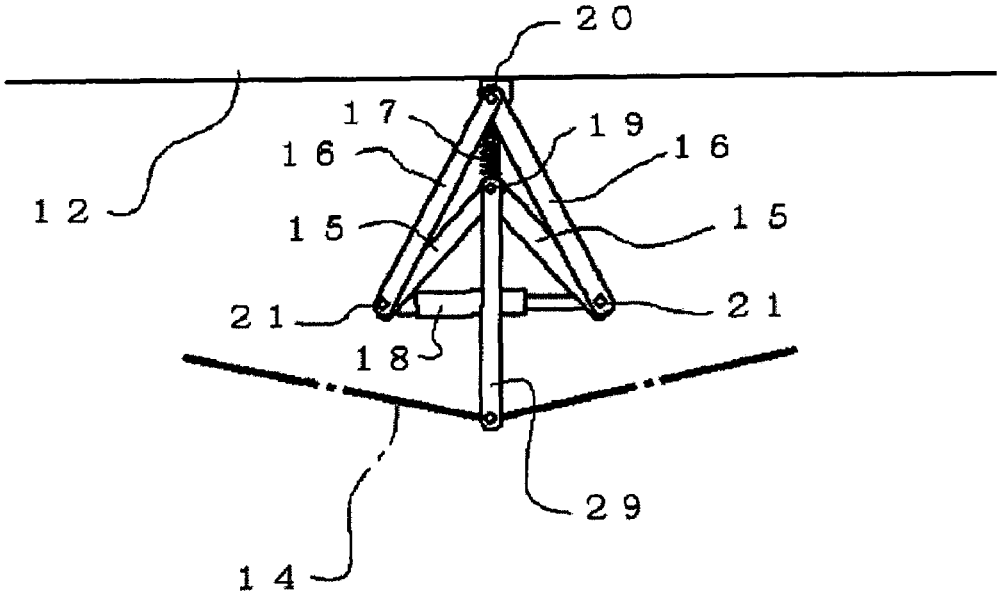

Also, as shown in FIG. 13B, the energizing member 17 can be placed between the pin 20 and the pin 19, or the position of this energizing member 17 and the damping member 18 could be switched.

Figure 13C:
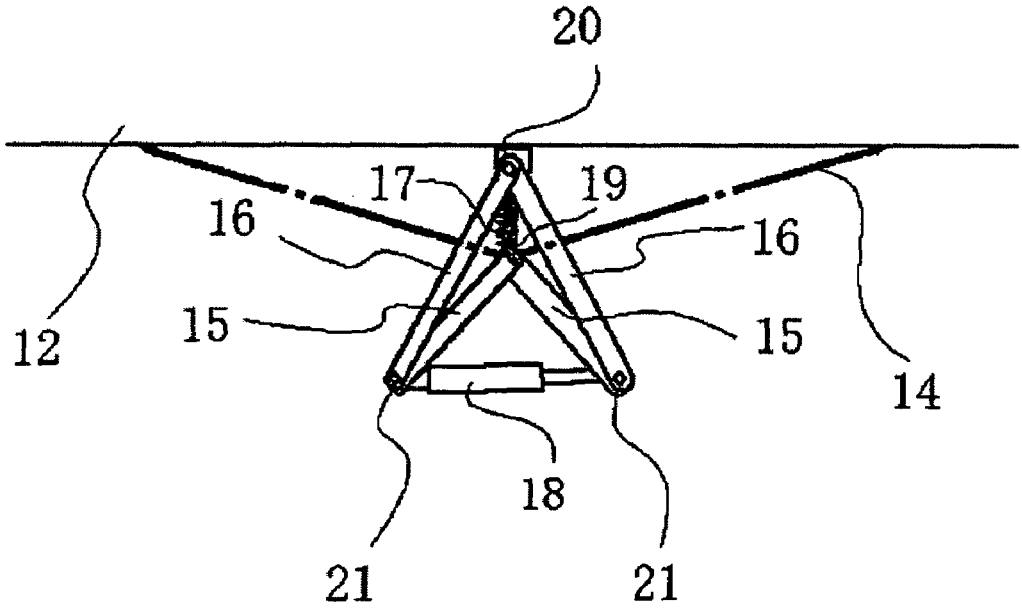

Also, the tension member 14 can be connected to the first link pieces 15, 15 as shown in FIG. 13C.

Figure 14:
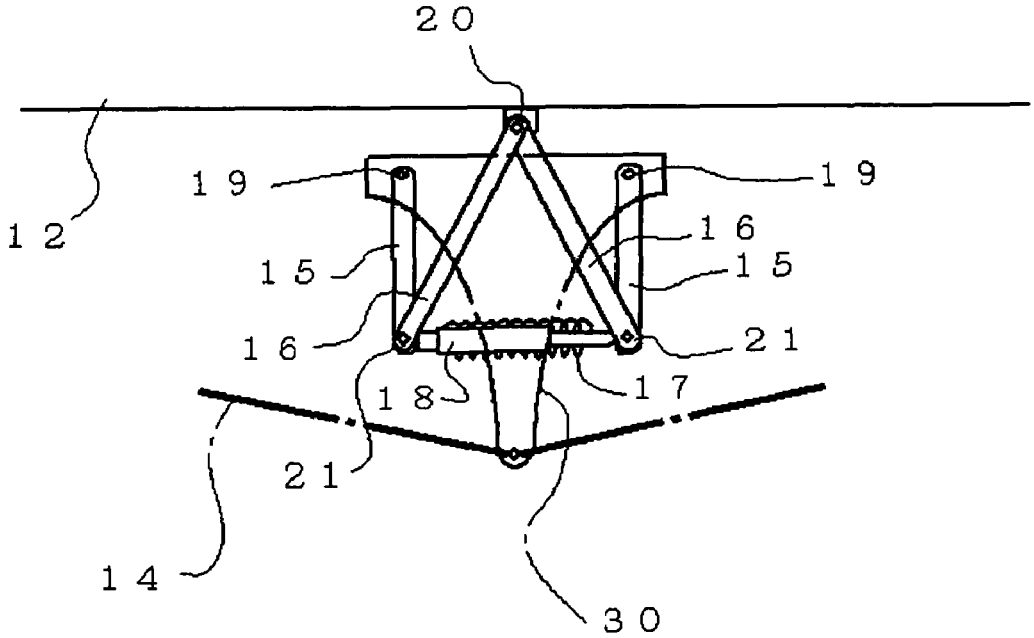
FIG. 14 is a front view showing an example of a modification to the present invention.

Moreover, as shown in FIG. 14, construction is possible in which the other ends of the pair of first link pieces 15 shown in FIG. 13 are located further on the outside than the second link pieces 16, and the other ends of these first link pieces 15 and the tension member 14 are connected by a connection plate 30 shown by the dot dashed line in FIG. 14 such that they can rotate freely.

Figure 15:
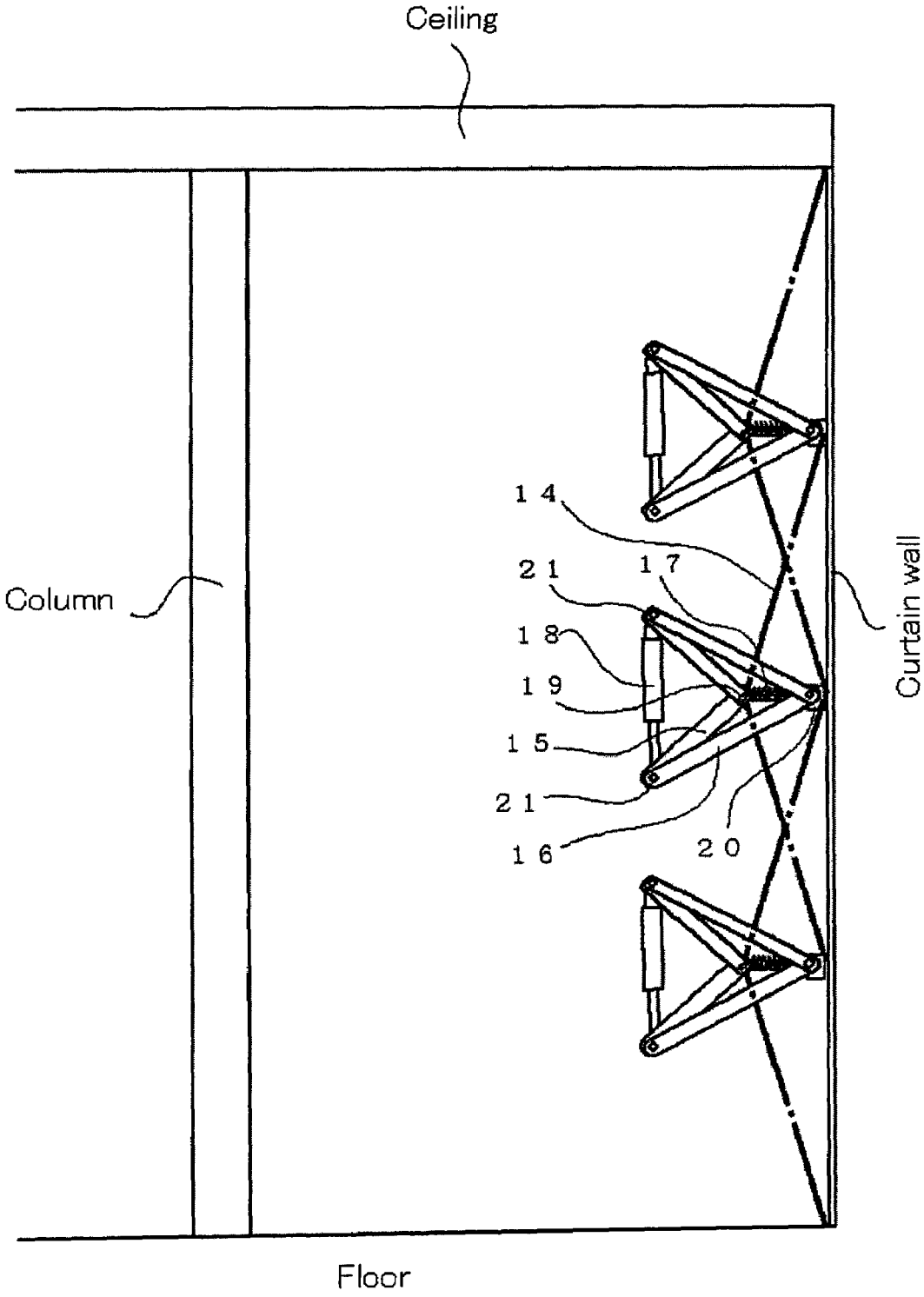
FIG. 15 is a front view showing an example of a modification to the present invention.
Figure 16:
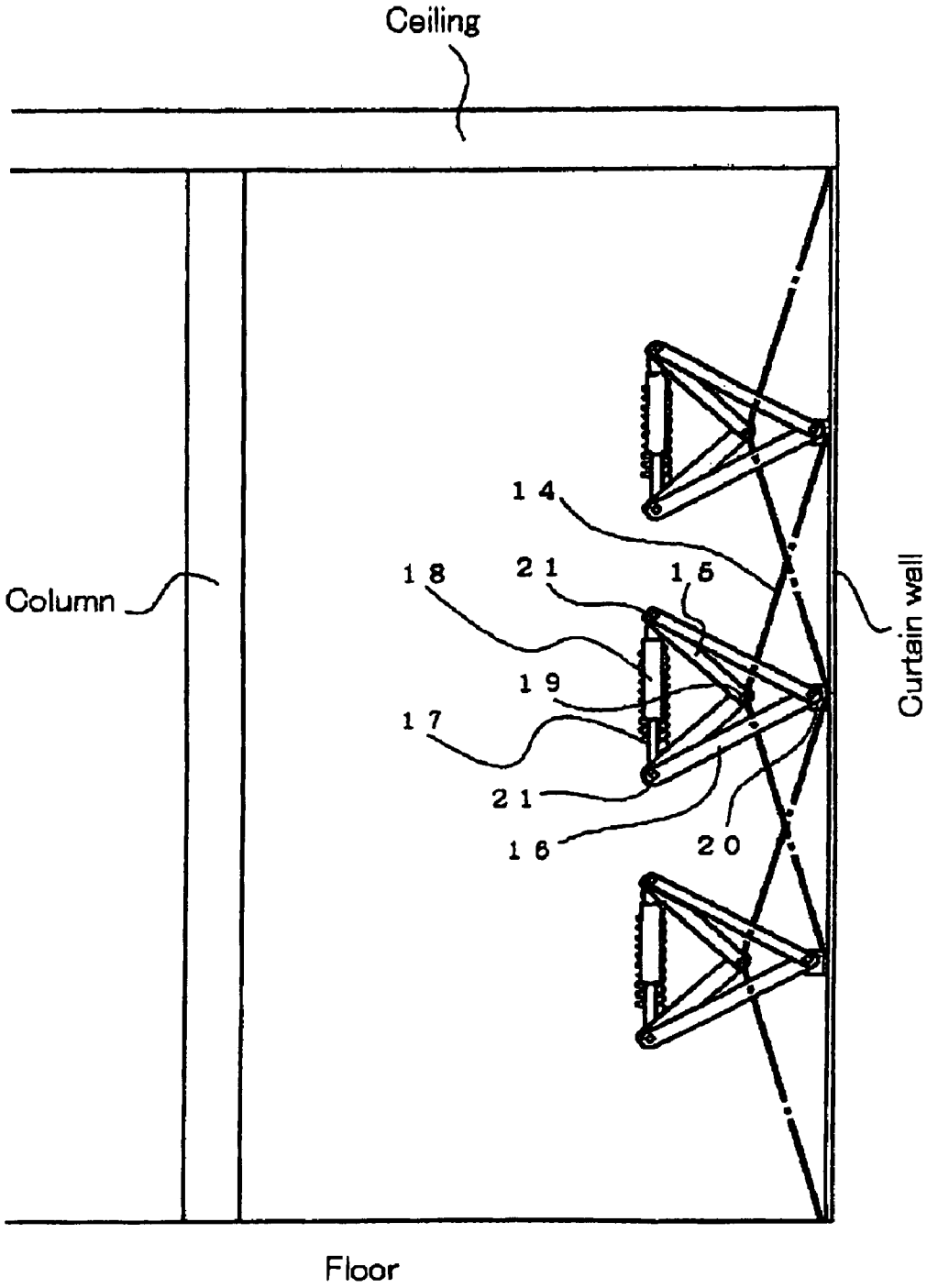
FIG. 16 is a front view showing an example of a modification to the present invention.

Furthermore, as shown in FIG. 15, this embodiment can be applied to a wall structure such as a curtain wall to suppress vibration of the curtain wall or the like. Also, damping members 17 can be installed as shown in FIG. 16.

In any of these modifications, the same functional effect as the embodiment described above can be obtained.

Furthermore, the case of the floor slab 12 being in a horizontal state was explained, however, the present invention can all be used as a base isolation device for suppressing vibration in the out-of-plane direction of structural members of an inclined roof, or the structural-support members of a vertically standing glass curtain wall.

INDUSTRIAL APPLICABILITY

As explained above, with the base isolation device for a structure of this present invention, by transmitting vibration in the out-of-plane direction of a structure such as a floor slab directly to a damping member, the operation of this damping member is performed, and by magnifying the vibration in the out-of-plane direction of a structural member and transmitting it to the damping member, the amount of operation of this damping member is greatly increased, and it absorbs the energy that accompanies the vibration of the structural member, and thus it is possible to maintain the function of base isolation of the structural member.

What is claimed is:

1. A base isolation device for a structure that suppresses vibration in the out-of-plane direction of a structural member of the structure and comprising:

a tension member which is constructed, in a state of tension, between support points, which are located on said structural member and separated by a specified space, and has an overall length that is longer than the space between these support points;

first link pieces and second link pieces which become a group, respectively and are located at two locations separated by a space in the direction of length of said tension member, and each of which is connected together such that each can rotate freely, thus forming two sets of connections; and an energizing member and a damping member which are located between said two sets of connections between first link pieces and second link pieces, respectively;

wherein the ends of said first link pieces are connected to a intermediate part of said tension member such that they can rotate freely;

wherein the ends of said second link pieces are connected to a intermediate part of said structural member such that they can rotate freely;

wherein said energizing member keeps tension applied to the said tension member by energizing said two connections in a direction such that they approach each other; and wherein said damping member absorbs said vibration with said vibration, when said two connections carry out relative displacement of said two connections.

2. The base isolation device for a structure of claim 1 wherein mass is added at the connections between said first link pieces and said second link pieces.

3. The base isolation device for a structure of claim 1 wherein said tension member is constructed using rope.

4. The base isolation device for a structure of claims 1 wherein said tension member is constructed using a plurality of steel rods that are connected to each other such that they can rotate freely.

5. The base isolation device for a structure of claim 1 wherein said damping member is an oil damper.

6. The base isolation device for a structure of claim 1 wherein said damping member is an active damper, and together with locating a sensor for detecting shaking on said structural member, a controller is installed that adjusts the operation of said active damper based on the detection signal from the sensor.

7. The base isolation device for a structure of claim 6 wherein said sensor is an acceleration sensor.

8. The base isolation device for a structure of claim 6 wherein said sensor is a displacement sensor.

9. The base isolation device for a structure of claim 6 wherein said sensor is a velocity sensor.

10. The base isolation device for a structure of claim 1 wherein said damping member is a viscoelastic member or elasto-plastic member.

* * * * *